US009770805B2

(12) United States Patent
Livescu et al.

(10) Patent No.: US 9,770,805 B2
(45) Date of Patent: Sep. 26, 2017

(54) METHOD FOR INCREASING THE ROUGHNESS OF INJECTOR GRIPPER BLOCKS FOR COILED TUBING OPERATIONS

(71) Applicant: BAKER HUGHES INCORPORATED, Houston, TX (US)

(72) Inventors: Silviu Livescu, Calgary (CA); Vivekanand Sista, The Woodlands, TX (US); John Delorey, Calgary (CA); Thomas J. Watkins, Calgary (CA)

(73) Assignee: BAKER HUGHES INCORPORATED, Houston, TX (US)

( * ) Notice: Subject to any disclaimer, the term of this patent is extended or adjusted under 35 U.S.C. 154(b) by 395 days.

(21) Appl. No.: 14/508,712

(22) Filed: Oct. 7, 2014

(65) Prior Publication Data

US 2016/0097244 A1 Apr. 7, 2016

(51) Int. Cl.

| | |
|---|---|
| ***E21B 19/22*** | (2006.01) |
| ***B24C 1/06*** | (2006.01) |
| ***C23C 4/10*** | (2016.01) |
| ***C23C 8/68*** | (2006.01) |
| ***C23C 8/08*** | (2006.01) |

(52) U.S. Cl.

CPC ..... *B24C 1/06* (2013.01); *C23C 4/10* (2013.01); *C23C 8/08* (2013.01); *C23C 8/68* (2013.01); *E21B 19/22* (2013.01)

(58) Field of Classification Search

CPC ..... E21B 19/22

See application file for complete search history.

(56) References Cited

U.S. PATENT DOCUMENTS 3,269,066 A * 8/1966 Straub ..... B24C 1/06 264/162
4,787,837 A * 11/1988 Bell ..... B21B 27/005 264/284
5,411,162 A * 5/1995 Koziczkowski ..... C23C 4/00 220/320
6,231,969 B1 * 5/2001 Knight ..... C23C 4/06 428/332

(Continued)

FOREIGN PATENT DOCUMENTS

DE 3542847 A1 * 6/1987 ..... C21D 7/06

*Primary Examiner* — Cathleen Hutchins
*Assistant Examiner* — Ronald Runyan
(74) *Attorney, Agent, or Firm* — Parsons Behle & Latimer

(57) ABSTRACT

A method of increasing a roughness of coiled tubing injector blocks that includes providing a pair of gripper blocks each having a gripper surface configured to grip coiled tubing within an injector head and increasing a first roughness on the gripping surfaces to a second roughness. A coating may be applied to the gripping surfaces to increase the roughness. The coating may be chromium carbide, molybdenum boride, iron boride, titanium boride, or a transitional metal boride. The gripping surfaces may be treated to increase the roughness to a second roughness. The gripping surfaces may be blasted by abrasives or shot peened to increase the roughness. The second roughness may be greater than 20 μm. A system to inject coiled tubing into a wellbore may include an injector head, coiled tubing, and at least two gripper blocks having a gripping surface with a roughness of at least 20 μm.

12 Claims, 6 Drawing Sheets

(56) References Cited

U.S. PATENT DOCUMENTS

| | | | | |
|---|---|---|---|---|
| 2003/0196815 | A1* | 10/2003 | Crawford | E21B 17/203<br>166/369 |
| 2008/0233838 | A1* | 9/2008 | Mase | B24C 1/06<br>451/38 |
| 2013/0322804 | A1* | 12/2013 | von Schleinitz | C09D 5/106<br>384/548 |
| 2014/0290932 | A1* | 10/2014 | Crnogorac | E21B 19/22<br>166/77.3 |

* cited by examiner

METHOD FOR INCREASING THE ROUGHNESS OF INJECTOR GRIPPER BLOCKS FOR COILED TUBING OPERATIONS

BACKGROUND

Field of the Disclosure

The embodiments described herein relate to a method and system to increase the roughness of the gripping surface of coiled tubing injector head gripper blocks.

Description of the Related Art

Coiled tubing is used in various wellbore operations. FIG. 1 shows a trailer mounted coiled tubing reel 20 that stores the coiled tubing 30 prior to insertion into the wellhead 80. The coiled tubing 30 is unreeled and nominally straightened prior to insertion into the wellhead 80. An operator in a control cabin 10 controls the insertion of the coiled tubing 30. The coiled tubing 30 travels along a gooseneck 40 and into an injector head 100. A crane 50 is used to suspend the injector head 100 above the wellhead 80. Gripping blocks within the injector head 100 grip the coiled tubing 30 and are used to insert the coiled tubing 30 into the wellhead 80 as well as to remove the coiled tubing 30 from the wellhead 80. A stuffing box 60 positioned below the injector head 100 provides the primary operation seal between pressurized wellbore fluid and the surface. The coiled tubing 30 then travels through a blowout preventer (BOP) 70 and into the wellhead 80.

The gripper blocks within the injector head 100 support that coiled tubing 30 and are used to raise or lower the coiled tubing 30. The gripper blocks are pressed against the coiled tubing 30 to hold the coiled tubing 30 in place. The coiled tubing 30 is held in place by the friction force between the gripper blocks and the coiled tubing 30. The friction force is comprises of the normal force applied by the gripper blocks against the coiled tubing 30 and the coefficient of friction between the gripper blocks and the coiled tubing 30. As the weight of the coiled tubing 30 increases, the friction force may also need to increase to adequately support the coiled tubing 30. The friction force may be increased by either increasing the nominal force and/or increasing the coefficient of friction. The structural properties of the coiled tubing 30 may limit the total normal force that may be applied against the coiled tubing 30 without damaging the coiled tubing 30.

As the lengths of wellbores continue to increase, the weight of the coiled tubing string also increases. If the gripper blocks don't adequately support the coiled tubing 30, the coiled tubing 30 may slip within the injector head 100. Slippage of the coiled tubing 30 may cause at least two problems. Slippage may cause the coiled tubing 30 to become damaged. For example, slippage within the injector head 100 may cause the coiled tubing 30 to be gouged, potentially compromising the integrity of the coiled tubing, which may result in the expense of replacing the coiled tubing string. Secondly, most well intervention operations require precise positioning of a tool or bottom hole assembly connected to the coiled tubing 30. Slippage of the coiled tubing 30 through the coiled tubing 30 may interfere with precise positioning during well intervention operations. Thus, there is a need to prevent slippage of coiled tubing 30 within an injector head 100.

SUMMARY

The present disclosure is directed to a method of increasing the roughness of coiled tubing injector gripper blocks that overcomes some of the problems and disadvantages discussed above.

One embodiment is a method of increasing a roughness of coiled tubing injector gripper blocks comprising providing a pair of gripper blocks, the pair of gripper blocks each having a gripping surface with a first roughness, the gripping blocks configured to grip coiled tubing within an injector head. The method comprises increasing the first roughness to a second roughness. The method of increasing the first roughness to a second roughness may comprises applying a coating to the gripping surface of the pair of gripper blocks. The coating may be chromium carbide, molybdenum boride, iron boride, titanium boride, nickel boride, chromium boride, or a transitional metal boride. Applying the coating may comprise applying the coating by thermal spaying, electrochemical boronizing, pack boronizing, paste boronizing, plasma boronizing, or gas boronizing, Increasing the first roughness to the second roughness may comprises treating the gripping surfaces to increase the first roughness to the second roughness. The gripping surfaces may be treated with or without having a coating on the surface. Treating the gripping surfaces may comprise abrasive blasting or shot peening. The second roughness may be at least 20 μm.

One embodiment is a system to inject coiled tubing into a wellbore comprising an injector head and at least two griper blocks within the injector head, with the gripper blocks each having a gripping surface. The system includes coiled tubing and wherein a roughness of the gripping surfaces is greater than 20 μm. The system may include a coating on the gripping surfaces. The coating may be chromium carbide, molybdenum boride, iron boride, titanium boride, nickel boride, chromium boride, or a transitional metal boride. The coating may be applied by thermal spaying, electrochemical boronizing, pack boronizing, paste boronizing, plasma boronizing, or gas boronizing. The gripping surfaces may have been treated to increase the roughness greater than 20 μm. The gripping surfaces may have been shot peened or sprayed with an abrasive to increase the roughness to greater than 20 μm. The coiled tubing may be coiled tubing comprised of stainless steel having 16% chromium (Cr16). The system may include a lubricant that reduces a roughness of the Cr16 coiled tubing. The roughness of the gripping surface may have been increased to compensate for the reduction of the roughness of the Cr16 coiled tubing by the lubricant.

Figure 1:
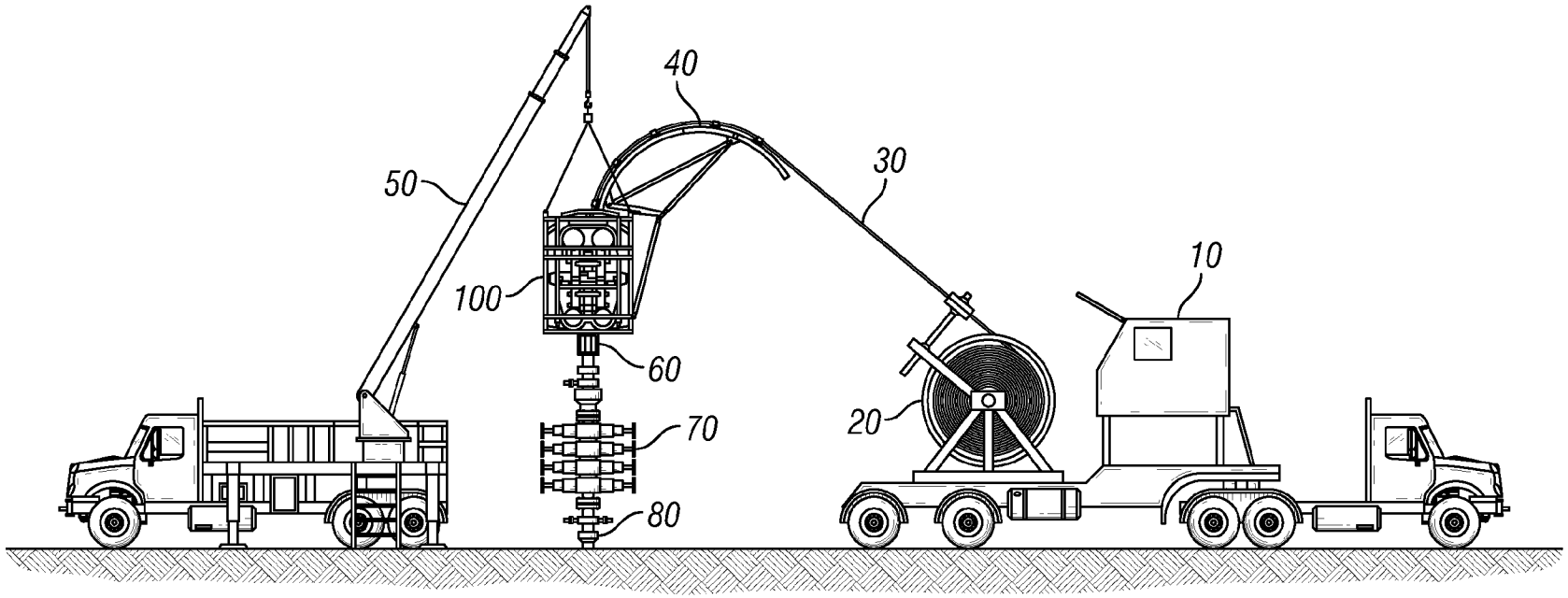
FIG. 1 show a reel of coiled tubing with coiled tubing being inserted into a wellbore via an injector head.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

Figure 2:
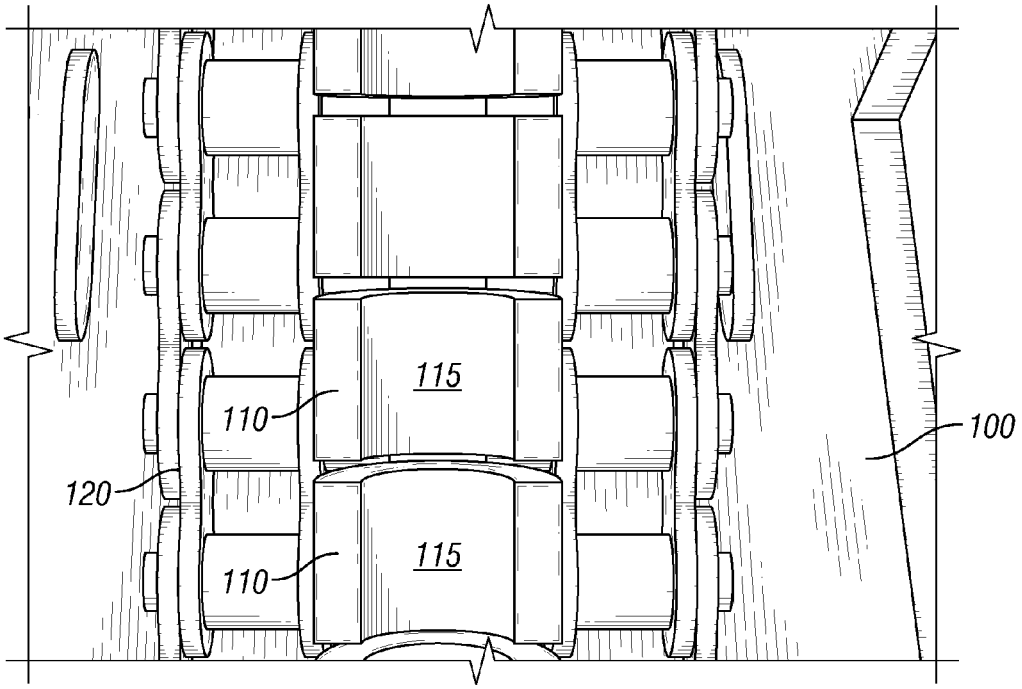
FIG. 2 shows a plurality of gripper blocks within an injector head.

FIG. 2 shows a plurality of gripper blocks 110 positioned within an injector head 100. The gripper blocks 110 each include a gripping surface 115 that is forced against coiled tubing 30 to provide a normal force against the coiled tubing 30. Two gripper blocks 110 (only one side is shown in FIG. 2) on either side of the coiled tubing 30 hold the coiled tubing 30 in place with a friction force. A chain 120 connected to the gripper blocks 110 may be rotated around a motor to advance the coiled tubing 30 into the wellhead 80 or pull the coiled tubing 30 out of the wellhead 80.

Figure 3:
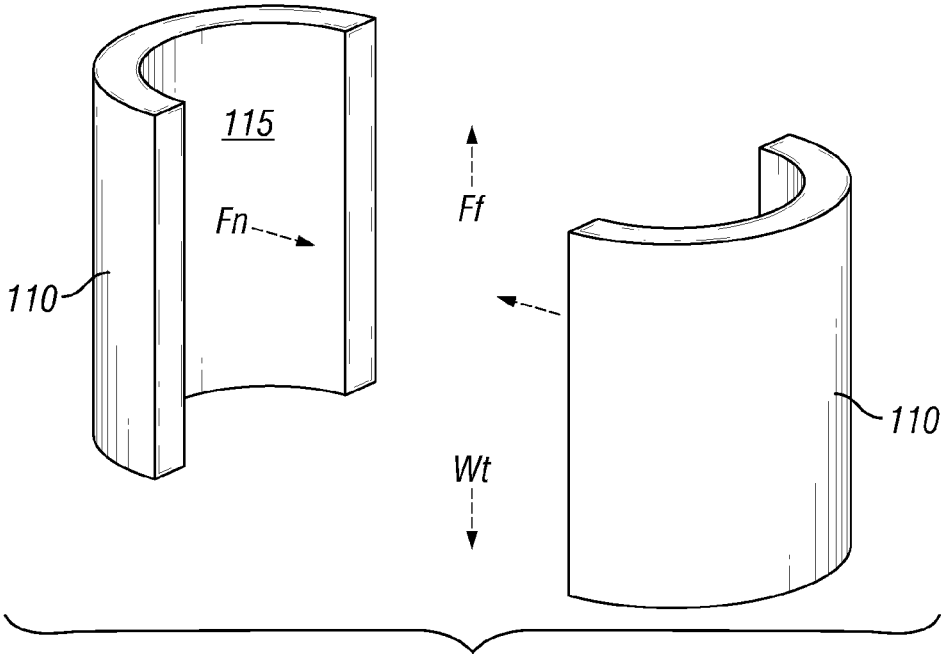
FIG. 3 shows a schematic of a pair of gripper blocks.

FIG. 3 shows a pair of gripper blocks 110 that could be used to support coiled tubing 30 within an injector head 100. The friction force, $F_f$, must be equal to or greater than the weight, Wt, of the coiled tubing 30 in order to adequately support the coiled tubing 30 within the injector head. The friction force, $F_f$, is equal to the normal force, Fn, applied to the coiled tubing 30 by the gripping surface 115 times the coefficient of friction between the gripping surface 115 and the coiled tubing 30. The properties of the coiled tubing 30 may limit the amount of normal force, Fn, which may be applied to the coiled tubing 30 to prevent damage to the coiled tubing 30. Thus, it may be necessary to increase the coefficient of friction in order to increase the friction force, $F_f$.

The length of the wellbore may necessitate the need to increase the friction force, $F_f$, because the weight of the coiled tubing 30 will increase as the length of the coiled tubing 30 within the wellbore increases. In an effort to increase the coefficient of friction, it may be necessary to increase the roughness of the gripping surface 115 of the gripper blocks 110. The coiled tubing 30 used in a wellbore intervention may itself necessitate the need to increase the roughness of the gripping surface 115 of the gripper blocks 110. For example, the well intervention may require the use of coiled tubing 130 (shown in FIG. 7) comprised of stainless steel having 16% Chromium (Cr16) instead of convention coiled tubing 30. For example, Cr16 coiled tubing 130 may be preferred with the wellbore is a sour wellbore, but Cr16 coiled tubing 130 has a lower roughness than convention steel coiled tubing 30. Thus, it may be necessary to increase the roughness of the gripping surface 115 of the gripper blocks 110 just to provide the same friction force, $F_f$, applied by gripper blocks 110 in combination with the Cr16 coiled tubing 130 in comparison to being used with convention coiled tubing 30. The presence of a lubricant 140 (shown in FIG. 8) may also lower the roughness of the exterior of the coiled tubing 30 or 130, which may necessitate increasing the roughness of the gripping surface 115 of the gripper blocks 110. The coiled tubing 30 or 130 may be inserted into the wellbore without any lubricant on the exterior, but upon extraction of the coiled tubing 30 or 130 a substance on the exterior, such as lubricant, may lower the roughness of the exterior of the coiled tubing 30 or 130.

The gripping surface 115 of conventional gripper blocks 110 may have a roughness of approximately 10 μm when the block 110 is new. The roughness may decrease to 3-5 μm as the gripping surface 115 is worn through use. Steps may be taken to increase the roughness of the gripping surface 115 of gripper blocks 110 in an effort to prevent slippage of the coiled tubing 30 or 130 within the injector head 100. For example, the roughness may be increased above 20 μm in an effort to prevent slippage.

Figure 4:
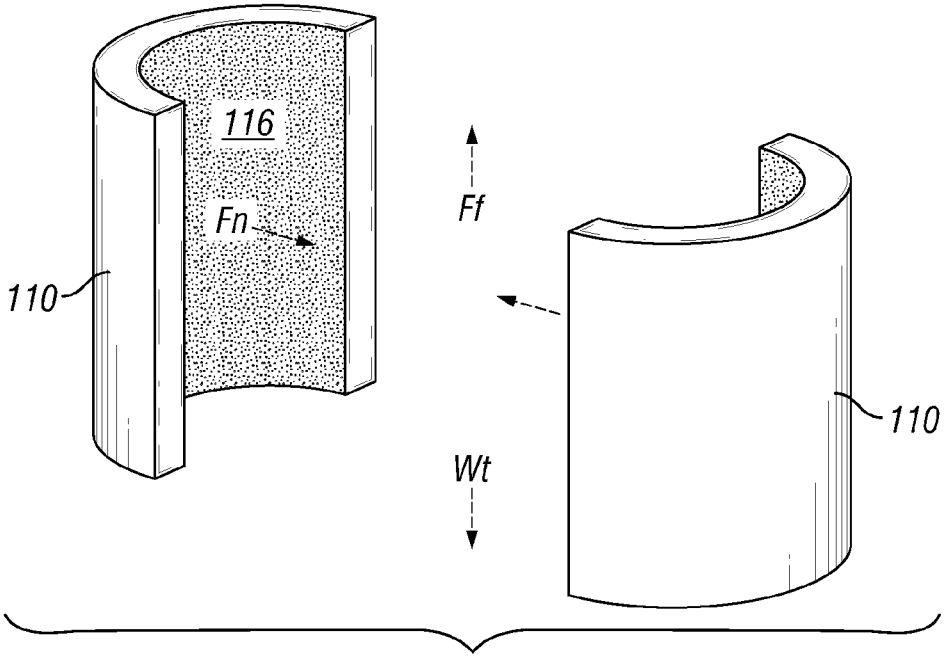
FIG. 4 shows a schematic of a pair of gripper blocks having increased roughness.

In one embodiment, a coating 116 may be applied to the gripping surface 115 of gripper blocks 110 to increase the roughness of the gripping surface 115 as shown in FIG. 4. Prior to the application of a coating 116, the roughness of the gripping surface 115 may be a first roughness. The coating 116 may increase the roughness of the gripping surface 115 to a second roughness that is greater than the first roughness. The increase in roughness by the application of the coating 116 may be done to compensate for a decrease in roughness of the exterior of the coiled tubing 30 due to the use of a coiled tubing, such as Cr16 coiled tubing, having a lower roughness than conventional coiled tubing and/or due to the presence of a lubricant or other material on the exterior of the coiled tubing 30.

Various coatings 116 may be applied to adequately increase the roughness of the gripping surface 115 as would be appreciated by one of ordinary skill in the art having the benefit of this disclosure. For example, the coating may be chromium carbine, molybdenum boride, iron boride, titanium boride, nickel boride, chromium boride, or various transitional metal borides. The coatings may be applied to the gripping surface 115 of the gripper blocks 110 by various mechanisms as would be appreciated by one of ordinary skill in the art having the benefit of this disclosure. For example, the coatings may be applied via thermal spraying or various boronizing procedures, in which boron is introduced into the metal of the gripping surface 115. Some boronizing procedures include electrochemical boronizing, pack boronizing, paste boronizing, plasma boronizing, and gas boronizing. The application of the coating 116 may in itself increase the roughness of the gripping surface 115.

Figure 5:
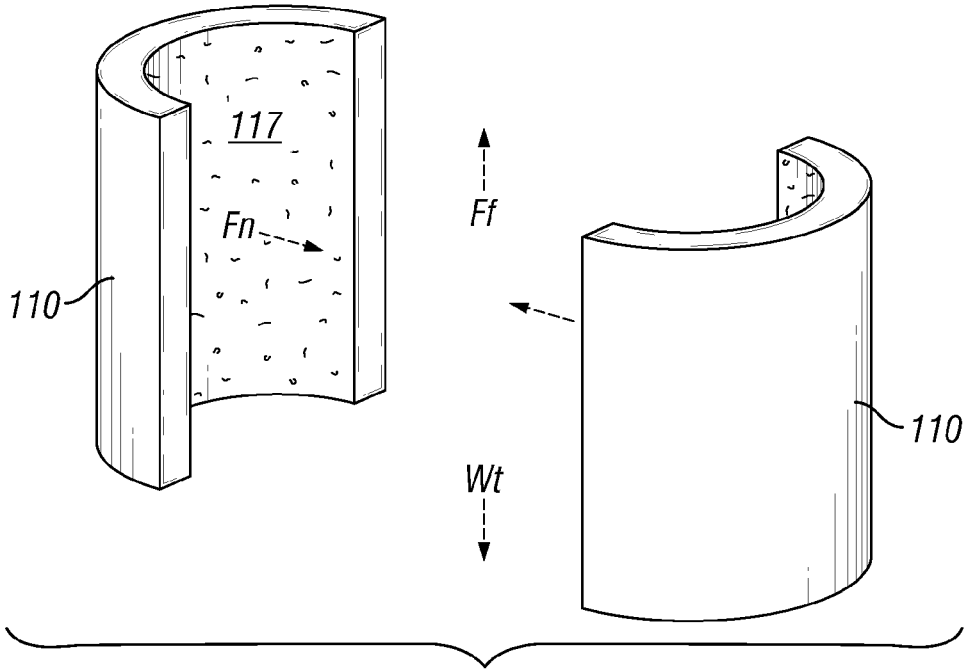
FIG. 5 shows a schematic of a pair of gripper blocks having increased roughness.
Figure 6:
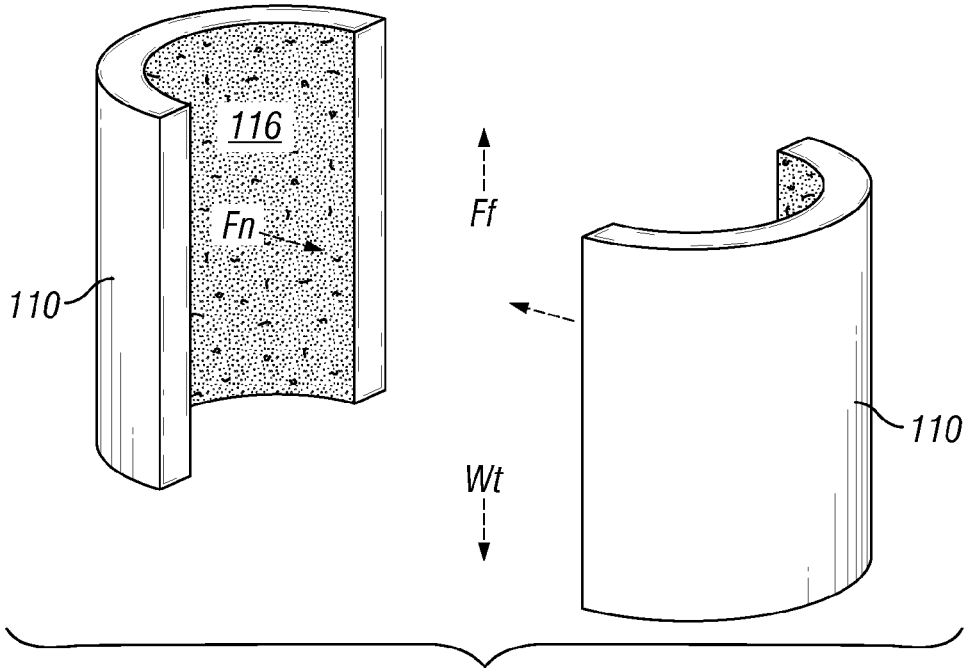
FIG. 6 shows a schematic of a pair of gripper blocks having increased roughness.

In one embodiment, the gripping surface 115 of the gripper blocks 100 may be treated by various procedures to increase the roughness of the gripping surface 115. FIG. 5 shows a treated surface 117 having an increased roughness. The roughness of the surface 115 may be increased by various procedures as would be recognized by one of ordinary skill in the art having the benefit of this disclosure. For example, the surface 115 may be subjected to an abrasive blast or spray and/or the surface may be subjected to shot peening. Prior to the treatment of the surface, the roughness of the gripping surface 115 may be a first roughness. The treatment may increase the roughness of the gripping surface 115 to a second roughness that is greater than the first roughness. The increase in roughness by the treating procedure may be done to compensate for a decrease in roughness of the exterior of the coiled tubing 30 due to the use of a coiled tubing, such as Cr16 coiled tubing, having a lower roughness than conventional coiled tubing and/or due to the presence of a lubricant or other material on the exterior of the coiled tubing 30. The treatment may be done to a gripping surface 115 that has already been coated 116 to potentially produce an even high roughness of the gripping surface 115 as shown in FIG. 6.

Figure 7:
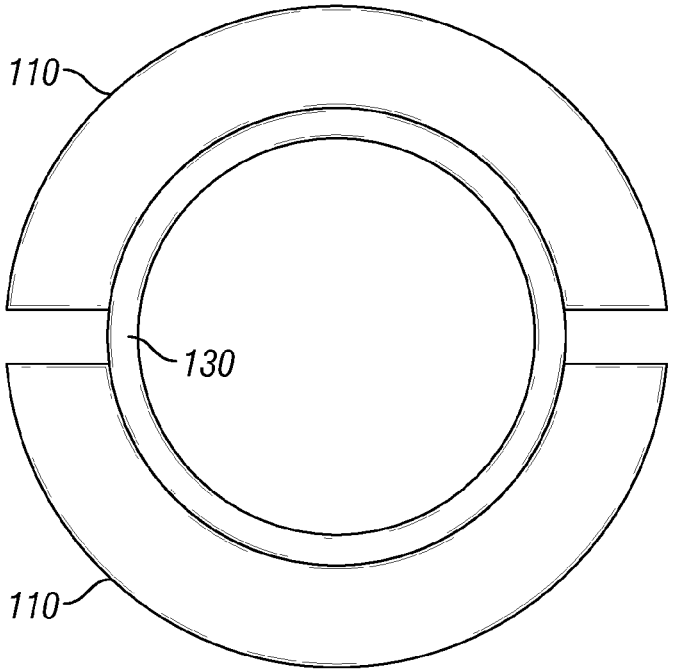
FIG. 7 shows a partial cross-section of a pair of gripper blocks having increased roughness gripping a Cr16 coiled tubing.
Figure 8:
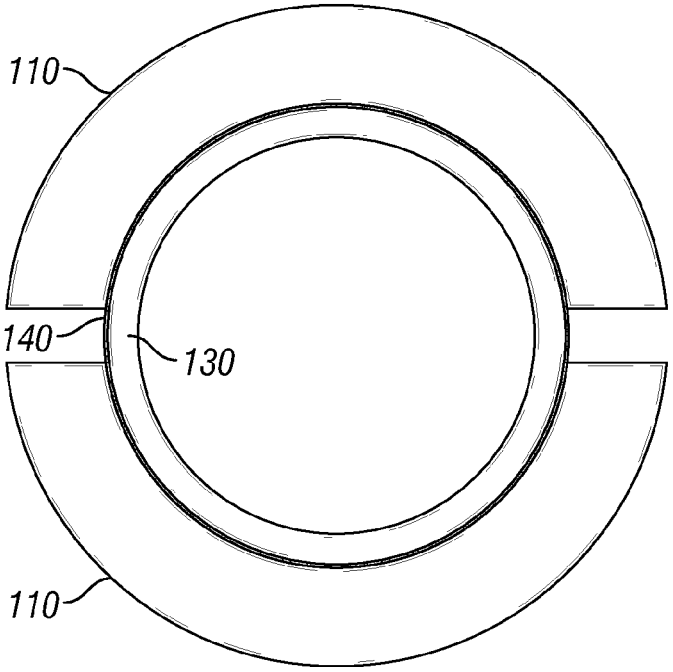
FIG. 8 shows a partial cross-section of a pair of gripper blocks having increased roughness gripping a Cr16 coiled tubing having lubricant on the outside of the Cr16 coiled tubing.

FIG. 7 shows two gripper blocks 110 gripping a Cr16 coiled tubing 130 that has a lower exterior roughness than conventional coiled tubing. FIG. 8 shows two gripper blocks 110 gripping a Cr16 coiled tubing 130 that also has a lubricant on the exterior. The roughness of the gripping surfaces 115 of the gripper blocks 110 may be increased to compensate for a decrease in the roughness of the exterior of the coiled tubing 130 due to material and/or a substance on the exterior of the coiled tubing 130.

Figure 9:
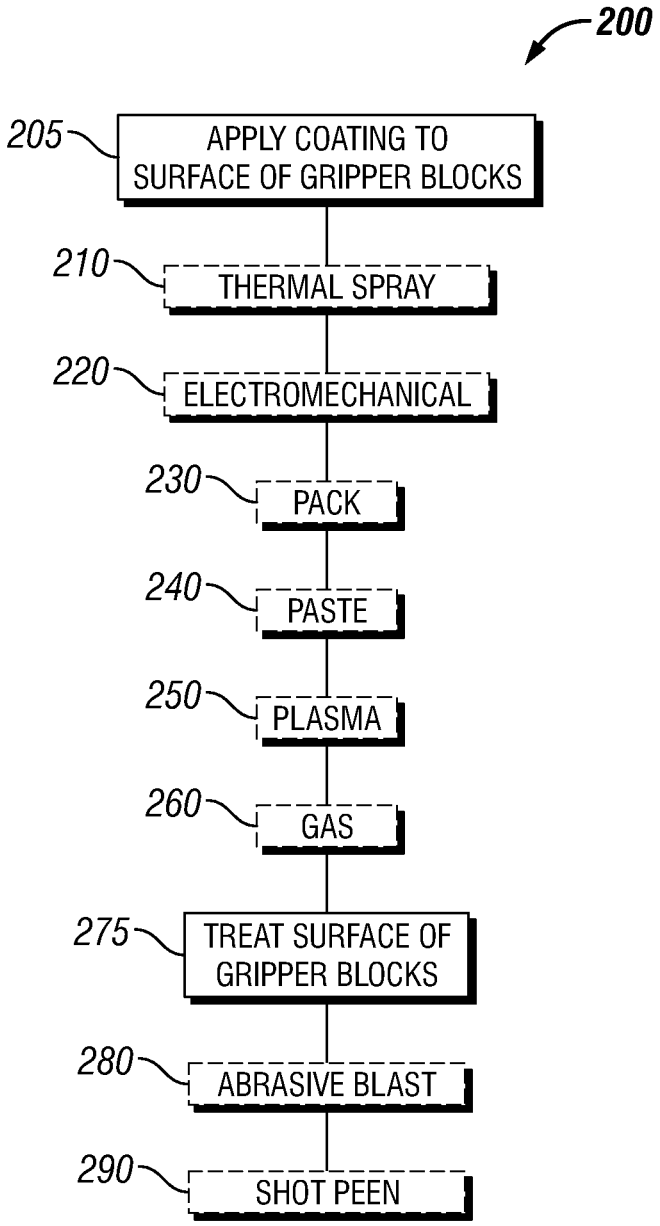
FIG. 9 shows a flow chart of one embodiment of a method to increase the roughness of injector head gripper blocks.

FIG. 9 shows a flow chart of one embodiment of a method 200 of increasing the roughness of a gripping surface 115 of a gripper block 110. A coating may be applied to the gripping surface 115 in step 205. The coating and/or the application process may increase the roughness of the gripping surface 115. The coating may be applied by various methods. For example the coating may be applied to the surface by thermally spraying 210, electromechanically boronizing 220, pack boronizing 230, paste boronizing 240, plasma boronizing 250, gas boronizing 260, or by other processes as would be appreciated by one of ordinary skill in the art having the benefit of this disclosure. The gripping surface 115 of the gripper block 110 may be treated in step 275 to increase the roughness. For example, the surface may be abrasively sprayed or blasted 280 or the surface may be shot peened 290. Other process could be used to roughen the gripping surface 115 of the gripper blocks 110 as would be appreciated by one of ordinary skill in the art. The gripping surface 115 may be coated and/or treated to increase the roughness to increase the friction force between the coiled tubing 30 or 130 and the gripper blocks 110.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A method of increasing a roughness of coiled tubing injector gripper blocks comprising:

providing a pair of gripper blocks, the pair of gripper blocks each having a gripping surface with a first roughness, the gripping blocks configured to grip coiled tubing within an injector head;

applying a coating to the gripping surfaces of the pair of gripper blocks to increase the first roughness on the gripping surfaces; and after the coating has been applied to the gripping surfaces of the pair of gripper blocks, abrasive blasting or shot peening the gripping surfaces to increase the first roughness on the gripping surfaces.

2. The method of claim 1, the coating comprising chromium carbide, molybdenum boride, iron boride, titanium boride, nickel boride, chromium boride, or a transitional metal boride.

3. The method of claim 2, the applying the coating further comprises applying the coating by thermal spraying, electrochemical boronizing, pack boronizing, paste boronizing, plasma boronizing, or gas boronizing.

4. The method of claim 1, wherein the second roughness is at least 20 μm.

5. The method of claim 1, wherein the increase in the first roughness via the coating combined with the increase in the first roughness via the abrasive blasting or shot peening compensates for a decrease in roughness of an exterior of coiled tubing comprised of stainless steel having 16% chromium (Cr16) and a lubricant.

6. A system to inject coiled tubing into a wellbore comprising:

an injector head;

at least two gripper blocks within the injector head, the gripper blocks each having a gripping surface; and coiled tubing, the coiled tubing comprises coiled tubing comprised of stainless steel having 16% chromium (Cr16) and a lubricant that reduces a roughness of the Cr16 coiled tubing;

wherein a roughness of the gripping surfaces is greater than 20 μm.

7. The system of claim 6, further comprising a coating on the gripping surfaces.

8. The system of claim 7, wherein the coating comprises chromium carbide, molybdenum boride, iron boride, titanium boride, nickel boride, chromium boride, or a transitional metal boride.

9. The system of claim 8, wherein the coating has been applied to the gipping surface by thermal spraying, electrochemical boronizing, pack boronizing, paste boronizing, plasma boronizing, or gas boronizing.

10. The system of claim 6, wherein the gripping surfaces have been treated to increase the roughness greater than 20 μm.

11. The system of claim 10, wherein the gripping surfaces have been shot peened or sprayed with an abrasive to increase the roughness greater than 20 μm.

12. The system of claim 6, wherein the roughness of the gripping surfaces has been increased to compensate for the reduction of the roughness of the Cr16 coiled tubing by the lubricant.

* * * * *